US009132663B2

(12) United States Patent
Kueckendahl et al.

(10) Patent No.: US 9,132,663 B2
(45) **Date of Patent: *Sep. 15, 2015**

(54) MARKING APPARATUS AND METHOD FOR OPERATING A MARKING APPARATUS

(75) Inventors: Peter Joerg Kueckendahl, Bad Oldesloe (DE); Daniel Joseph Ryan, Sycamore, IL (US)

(73) Assignee: Alltec Angewandte Laserlicht Technologie GMBH, Selmsdorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/976,809

(22) PCT Filed: Dec. 22, 2011

(86) PCT No.: PCT/EP2011/006514

§ 371 (c)(1),
(2), (4) Date: Jun. 27, 2013

(87) PCT Pub. No.: WO2012/089319

PCT Pub. Date: Jul. 5, 2012

(65) Prior Publication Data

US 2013/0293658 A1 Nov. 7, 2013

(30) Foreign Application Priority Data

Dec. 30, 2010 (EP) ..... 10016203

(51) Int. Cl.

| | |
|---|---|
| ***B41J 3/00*** | (2006.01) |
| ***B41J 2/46*** | (2006.01) |
| ***B41J 25/00*** | (2006.01) |

(52) U.S. Cl.
CPC .... *B41J 3/00* (2013.01); *B41J 2/46* (2013.01); *B41J 25/003* (2013.01)

(58) Field of Classification Search
CPC ..... B41J 3/00; B41J 2/0057; B41J 3/4076; B41J 25/308; B41J 29/393; B41J 2/46; B41J 25/003
See application file for complete search history.

(56) References Cited

U.S. PATENT DOCUMENTS

| | | | |
|---|---|---|---|
| 4,707,063 | A | 11/1987 | Plummer |
| 5,399,032 | A | 3/1995 | Itoh et al. |

(Continued)

FOREIGN PATENT DOCUMENTS

| | | |
|---|---|---|
| DE | 2401322 | 1/1974 |
| DE | 3826113 A1 | 2/1989 |

(Continued)

OTHER PUBLICATIONS

International Application No. PCT/EP2011/006514, Written Opinion of International Search Authority.

(Continued)

*Primary Examiner* — Manish S Shah
*Assistant Examiner* — Jeremy Delozier
(74) *Attorney, Agent, or Firm* — Hoffman Warnick LLC

(57) ABSTRACT

The invention relates to a marking apparatus for marking an object comprising a marking head having a plurality of receiving spaces for individual marking devices, wherein the receiving spaces are arranged in a plurality of rows and columns, such that a two-dimensional array of receiving spaces is formed, and a driving mechanism for providing a relative movement of the object relative to the marking head in an advance direction during a marking operation. The marking head is rotatable about an axis extending transversely to the advance direction, at least one detector device is arranged downstream of the receiving spaces in the advance direction, and a control marking, which has been applied by at least one marking device arranged in one of the receiving spaces during the movement of the object relative to the marking head, is detectable by the at least one detector device at different angles of rotation of the marking head. The invention further relates to a method for operating a marking apparatus.

13 Claims, 7 Drawing Sheets

(56) References Cited

U.S. PATENT DOCUMENTS

| | | | | |
|---|---|---|---|---|
| 5,477,259 | A | 12/1995 | Iwasa | |
| 5,777,634 | A | 7/1998 | Okamura et al. | |
| 5,784,098 | A | 7/1998 | Shoji et al. | |
| 6,189,991 | B1 | 2/2001 | Wen et al. | |
| 6,286,927 | B1 | 9/2001 | Taneya et al. | |
| 6,381,377 | B1 | 4/2002 | Wang | |
| 6,469,729 | B1 * | 10/2002 | Ryan | 347/248 |
| 6,738,086 | B2 | 5/2004 | Oka | |
| 6,855,921 | B1 | 2/2005 | Stopperan et al. | |
| 7,354,130 | B2 * | 4/2008 | Arakawa | 347/19 |
| 7,448,719 | B1 | 11/2008 | Newell | |
| 7,564,020 | B2 * | 7/2009 | Sergyeyenko | 250/208.4 |
| 7,671,337 | B1 | 3/2010 | Tidwell | |
| 7,908,968 | B2 * | 3/2011 | McCoin et al. | 101/476 |
| 2002/0001004 | A1 | 1/2002 | Mantell et al. | |
| 2002/0101469 | A1 | 8/2002 | Wade et al. | |
| 2002/0109741 | A1 | 8/2002 | Okabe et al. | |
| 2002/0139273 | A1 * | 10/2002 | Murata et al. | 101/484 |
| 2002/0191069 | A1 * | 12/2002 | Oka | 347/241 |
| 2003/0016348 | A1 | 1/2003 | Sallee | |
| 2003/0210861 | A1 | 11/2003 | Weiss et al. | |
| 2003/0235373 | A1 | 12/2003 | Ishii et al. | |
| 2004/0160478 | A1 | 8/2004 | Weijkamp et al. | |
| 2005/0122548 | A1 | 6/2005 | Cunnigan et al. | |
| 2005/0123303 | A1 | 6/2005 | Guttman et al. | |
| 2005/0140770 | A1 | 6/2005 | Kang et al. | |
| 2005/0286093 | A1 | 12/2005 | Sumi et al. | |
| 2006/0066924 | A1 | 3/2006 | Delueg | |
| 2006/0109525 | A1 | 5/2006 | Evans | |
| 2007/0091132 | A1 | 4/2007 | Lim | |
| 2007/0279713 | A1 | 12/2007 | Feng et al. | |
| 2008/0055352 | A1 | 3/2008 | Toh et al. | |
| 2008/0246962 | A1 | 10/2008 | Yang | |
| 2010/0002057 | A1 | 1/2010 | Hatasa et al. | |
| 2010/0102032 | A1 | 4/2010 | Bathelet | |
| 2010/0214387 | A1 * | 8/2010 | Fox et al. | 347/110 |
| 2010/0231929 | A1 | 9/2010 | Kakigi | |
| 2013/0021398 | A1 | 1/2013 | Mizes et al. | |
| 2013/0286147 | A1 | 10/2013 | Kueckendahl et al. | |
| 2013/0286148 | A1 | 10/2013 | Kueckendahl et al. | |
| 2013/0286149 | A1 | 10/2013 | Kueckendahl et al. | |
| 2013/0293658 | A1 | 11/2013 | Kueckendahl et al. | |
| 2013/0328978 | A1 | 12/2013 | Sekino et al. | |
| 2013/0342823 | A1 | 12/2013 | Kueckendahl et al. | |

FOREIGN PATENT DOCUMENTS

| | | | |
|---|---|---|---|
| EP | 0121369 | A2 | 10/1984 |
| EP | 0832754 | B1 | 12/1993 |
| EP | 0832752 | A2 | 4/1998 |
| EP | 1266763 | A1 | 12/2002 |
| EP | 1640169 | A3 | 9/2005 |
| EP | 1640169 | A2 | 3/2006 |
| EP | 1640169 | A3 | 10/2007 |
| EP | 2105309 | A1 | 9/2009 |
| JP | 59136267 | | 8/1984 |
| JP | 05185686 | | 7/1993 |
| JP | 2001332806 | A | 11/2001 |
| JP | 2007090814 | A | 4/2007 |
| JP | 2008126471 | A | 6/2008 |
| JP | 2009037128 | A | 2/2009 |
| WO | 8505187 | A1 | 11/1985 |
| WO | 2006037973 | A1 | 4/2006 |
| WO | 2007107030 | A1 | 9/2007 |
| WO | 20080104222 | A1 | 9/2008 |
| WO | 2009153795 | A1 | 12/2009 |

OTHER PUBLICATIONS

International Application No. PCT/EP2011/006515, International Preliminary Report on Patentability, Jan. 21, 2013.
International Application No. PCT/EP2011/006515, Written Opinion on Search Report.
U.S. Appl. No. 13/976,814, Notice of Allowance Dated Dec. 29, 2014, 10 pages.
International Application No. PCT/EP2011/006518, Written Opinion of International Search Authority.
International Application No. PCT/EP2011/006520, Written Opinion of International Search Authority.
International Application No. PCT/EP2011/006522, Written Opinion of International Search Authority.
International Application No. PCT/EP2011/006522, International Report on Patentability.
International Application No. PCT/EP2011/006521, Written Opinion of International Search Authority.
International Application No. PCT/EP2011/006521, Written Opinion of International Examining Authority.
U.S. Appl. No. 13/976,779, Office Action dated Jun. 16, 2014.
U.S. Appl. No. 13/976,804, Notice of Allowance dated Mar. 20, 2014.
U.S. Appl. No. 13/976,809, Office Action dated May 27, 2014.
U.S. Appl. No. 13/977,159, Office Action dated Jun. 20, 2014.
U.S. Appl. No. 13/976,832, Notice of Allowance and Fees Due dated Jun. 24, 2014.
International Application No. PCT/EP2011/00652023, Written Opinion of International Search Authority.
International Application No. PCT/EP2011/006517, Written Opinion of International Search Authority.
International Application No. PCT/EP2011/006519, Written Opinion of International Search Authority.
International Application No. PCT/EP2011/006519, Preliminary Report on Patentability.
International Application No. PCT/EP2011/006516, Written Opinion of International Search Authority.
U.S. Appl. No. 13/976,832, Notice of Allowance dated Oct. 8, 2014, 61 pages.
U.S. Appl. No. 13/976,814, Notice of Allowance dated Oct. 21, 2014, 72 pages.
U.S. Appl. No. 13/976,804, Final Office Action dated Oct. 24, 2014, pp. 18.
U.S. Appl. No. 13/977,159, Final Office Action dated Oct. 10, 2014, 53 pages.
U.S. Appl. No. 13/977,156, Final Office Action dated Dec. 5, 2014, 13 pages.
U.S. Appl. No. 13/976,793, Notice of Allowance dated Dec. 9, 2014, 66 pages.
U.S. Appl. No. 13/976,779, Notice of Allowance dated Oct. 21, 2014, 34 pages.
International Application No. PCT/EP2011/006516, International Search Report, dated Mar. 23, 2012, 3 pages.
U.S. Appl. No. 13/976,804, Office Action dated Jul. 8, 2014.
U.S. Appl. No. 13/976,793, Office Action dated Jul. 1, 2014.
U.S. Appl. No. 13/977,151, Notice of Allowance and Fees Due dated Aug. 4, 2014.
U.S. Appl. No. 13/977,156, Office Action dated Jul. 9, 2014.
U.S. Appl. No. 13/976,804, Notice of Allowance dated Apr. 30, 2015, 55 pgs.
U.S. Appl. No. 13/976,804, Notice of Allowance, Feb. 3, 2015, 11 pages.
U.S. Appl. No. 13/976,793, Notice of Allowance, Feb. 4, 2015, 16 pages.
U.S. Appl. No. 13/976,779, Notice of Allowance, Feb. 6, 2015, 18 pages.
U.S. Appl. No. 13/977,151, Office Action, Feb. 17, 2015, 70 pages.
U.S. Appl. No. 13/977,159, Notice of Allowance, Feb. 17, 2015, 15 pages.
U.S. Appl. No. 13/977,156, Notice of Allowance dated Mar. 16, 2015, 21 pgs.

* cited by examiner

MARKING APPARATUS AND METHOD FOR OPERATING A MARKING APPARATUS

FIELD OF THE INVENTION

The present invention relates to a marking apparatus for marking an object. The invention further relates to a method for operating a marking apparatus.

The marking apparatus comprises a marking head having a plurality of receiving spaces for individual marking devices. The receiving spaces are arranged in a plurality of rows and columns, such that a two-dimensional array of receiving spaces is formed. The apparatus further comprises a driving mechanism for providing a relative movement of the object relative to the marking head in an advance direction during a marking operation.

Related Art

In a known marking apparatus the receiving spaces and the marking devices, respectively, are arranged in a fixed pattern so that the marking apparatus has a defined resolution.

When a marking operation is carried out, the object is moved in the advance direction relative to the marking head and a marking is applied on the object by means of marking devices arranged in the receiving spaces of the marking head. The marking can in particular be applied on the object during the relative movement between the object and the marking head.

In order to achieve a good marking quality it is necessary to correctly adjust the position of the marking head relative to the movement direction of the object. If the actual advance direction of the object is slightly tilted relative to a desired advance direction or the position of the marking head is not correctly adjusted relative to the advance direction the marking quality might be reduced.

SUMMARY OF THE INVENTION

It is an object of the invention to provide a marking apparatus and a method for marking an object with a high marking quality.

The object is solved according to the invention with a marking apparatus. The object is further solved according to the invention with a method. Preferred embodiments of the invention are given in the dependent claims.

An inventive marking apparatus is characterized in that the marking head is rotatable about an axis extending transversely to the advance direction. Moreover, at least one detector device is arranged downstream of the receiving spaces in the advance direction, and a control marking, which has been applied by at least one marking device arranged in one of the receiving spaces during the movement of the object relative to the marking head, is detectable by the at least one detector device at different angles of rotation of the marking head.

An inventive method comprises the steps: the object is moved relative to the marking head in the advance direction, a control marking is applied by the at least one marking device during the movement of the object relative to the marking head, and the control marking is detected by a detector device which is arranged downstream of the at least one marking device. The marking head to be operated by the inventive method comprises a plurality of receiving spaces for individual marking devices for marking the object, the receiving spaces being arranged in a plurality of rows and columns, such that a two-dimensional array of receiving spaces is formed. At least one receiving space is equipped with a marking device. The marking head is rotatable about an axis extending transversely to the advance direction.

A first idea of the invention is to provide a marking apparatus and method with an adjustable marking resolution. To this end, the array of marking devices is arranged in a rotatable manner in the marking apparatus. Accordingly, the resolution of the marking can be changed by rotating the array of marking devices, in particular about a rotation axis extending perpendicular to a surface of the object to be marked and/or perpendicular to the advance or movement direction of the object. The marking resolution can be adjusted to a given marking task and therefore increase the marking quality.

A second aspect of the invention is to provide a method for determining an angle of rotation of the marking head and/or for setting up a defined angle with a desired marking resolution, taking into account the actual movement direction of the object relative to the marking head. The angle of rotation may also be referred to as a rotation angle or a tilt angle.

In order to determine the actual angle of rotation of the marking head a control or reference marking may be applied by one or more of the marking devices during a movement of the object relative to the marking head. The control marking, which may in particular be a marking line, can be detected by the detector device. As the control marking is applied during a movement of the object relative to the marking head, the control marking extends in the advance direction.

Depending on the rotation angle of the marking head the position of the marking is displaced in the transverse direction. That is, the position of the marking in the transverse direction depends on the rotation angle of the marking head, provided that the marking device is arranged eccentrically on the rotatable marking head. The rotation angle of the marking head can in particular be defined as an angle between a column of marking devices in the marking head and the actual advance direction of the object.

Hence, the position where the control marking is detected corresponds to the rotation angle of the marking head. If the position of the control marking is known, it is therefore possible to determine the rotation angle of the marking head.

Therefore, for example, the inventive apparatus and method can be used for determining the rotation angle of the marking head.

In addition, the apparatus and method provides a possibility to set up a defined rotation angle of the marking head with a predetermined marking resolution. The predetermined marking resolution can in particular be defined as a marking resolution having a predetermined characteristic. The predetermined marking resolution can for example be a marking resolution which allows for marking continuous lines in the transverse direction, in particular in a direction extending perpendicular to the advance direction of the object.

When the rotation or tilt angle of the marking head is 0° the resolution is generally defined by the pitch or distance of the receiving spaces of one row. The tilt angle of 0° is in particular given if the columns of the receiving spaces are aligned with the advance direction and/or the rows of the receiving spaces extend perpendicular to the advance direction.

The resolution can be enhanced by tilting or rotating the marking head. If the marking head is only tilted a very small angle, the marking resolution might not be constant for the entire marking head, as there might be larger gaps between two adjacent columns of marking devices in the transverse direction. If the marking head is tilted too much, the marking resolution might be too poor to mark a continuous line in a direction perpendicular to the advance direction.

The invention provides an apparatus and a method for determining and setting up a maximum rotation angle with which a continuous marking line in a direction perpendicular to the advance direction can be applied on the object.

To this end, marking is applied on the object by a plurality of marking devices arranged in one row of the marking head. As the row is tilted with regard to the advance direction, the marking will be a wide marking line that may also be called a marking bar. The wide marking line has a width wider than a marking applied by a single marking device. The width will in particular be defined by a spacing of a first and a last marking device in the column.

The marking bar can be detected and analyzed. Based on the analysis of the marking bar certain characteristics of the marking can be determined. It is in particular possible to determine if the set up tilt angle is appropriate for marking a continuous line at right angles to the advance direction of the object According to the invention it is helpful to know the position of the at least one detector device relative to the position of the at least one marking device which applies the control marking. It may therefore be preferred that the detector device is arranged within the marking head, in order to eliminate as much as possible any factors that might impair the defined, known position of the detector device relative to the marking device.

In order to provide the possibility to detect the control marking while the object is moved relative to the marking head, it may be preferred that the at least one detector device is arranged downstream of the receiving spaces in the advance direction.

An aspect of the inventive marking apparatus is the fact that the at least one detector device is configured to allow for a detection of the control marking at various different rotation angles of the marking head. The detector device therefore may cover a distance in the transverse direction being significantly larger than a width of a control marking line applied.

The at least one detector device may cover a substantial portion of the marking width of the marking head, for example at least 80 or 90% of the marking width of the marking head. More particularly, the detector device may cover at least the entire marking width of the marking head, in particular a width corresponding to a length or width of one row of receiving spaces.

In order to provide the possibility to detect the control marking at different angles of rotation of the marking head, one single detector device may be configured to cover a width in the transverse direction being larger than a width of a marking applied by a marking device.

It is also possible to provide a plurality of detector devices arranged in an array covering a width in the transverse direction being larger than a width of a marking applied by a marking device.

In a preferred embodiment the at least one detector device is movable along a defined movement path relative to the receiving spaces of a marking head, in order to cover a width being larger than a width of a marking applied by a marking device. In a preferred embodiment the movement path is arranged in the marking head.

The movement path may in particular extend in a transverse direction with regard to the advance direction and/or substantially parallel to a row of receiving spaces of the marking head and/or substantially perpendicular to a column of receiving spaces of the marking head. According to a preferred embodiment, the at least one detector device is therefore movable in a transverse direction relative to the advance direction.

For moving the detector device along the movement path it may be preferred that a slider or carriage is provided on which the detector device is arrangeable and which is movable with regard to the receiving spaces of the marking head. A drive unit comprising a motor can be provided for moving the slider.

The at least one detector device may be preferably movable along the defined movement path such that, at different angles of rotation of the marking head, it may be placed in a position in which it is aligned in the advance direction with regard to at least one of the receiving spaces.

In a preferred embodiment the at least one detector device is movable along a linear movement path. The linear movement path may in particular extend parallel to the rows of receiving spaces and/or perpendicular to the columns of receiving spaces. The linear movement path may facilitate a precise movement and an exact positioning of the detector device.

It may be preferred that a measuring device is provided for determining the position of the detector device detecting the control marking. The measuring device may in particular be configured to determine the position of the movable detector device at a time when the control marking is detected by the detector device. Therefore, the position of the control marking can be known based on the time when the control marking is detected by the moving detector device. Based on the position of the control marking and/or the detector device the rotation angle of the marking head can be determined.

In another preferred embodiment a processing unit is provided for determining a value of an angle of rotation based on the detected control marking. The processing unit may in particular have as an input value a position of the detected control marking.

In another preferred embodiment a processing unit is provided for determining a characteristic of the detected control marking. The processing unit may in particular be functionally connected to the at least one detector device. The characteristic of the detected control marking may in particular relate to the position of the control marking and/or the resolution of the control marking, in particular if the control marking is applied by a plurality of marking devices.

According to the invention the receiving spaces of the marking head and the marking devices coupled thereto are arranged in a two-dimensional array comprising rows and columns. The two-dimensional array may in particular be employed for an enhancement of the marking speed and/or the marking resolution, as already explained. The receiving spaces of the marking head can be entirely or partially equipped with marking devices.

According to the invention the two-dimensional array of receiving spaces and marking devices, respectively, is rotatable or tiltable about an axis extending transversely, in particular at right angles, to the advance direction and/or to a surface of the object to be marked.

Through the rotation of the array, the array can be arranged in a position, in which the receiving spaces of a successive row are offset with regard to the receiving spaces of a preceding row in the transverse direction. In other words, the receiving spaces of a successive row may be interposed between receiving spaces of a preceding row in the advance direction. Such a staggered arrangement of the receiving spaces, respectively marking devices, increases the marking resolution. The smaller the offset and the greater the number of rows, the greater is the resolution to be achieved.

For a precise movement of the marking head it may be preferred that a motor, in particular a stepper motor, is provided for rotating the marking head, in particular at defined small angle steps in the range of 0 to 90 degrees. The small angle steps are in particular steps of less than 1 degree, preferably less than 0.1 degrees. The motor may in particular be an electrical motor. The motor may in particular be controlled based on an output value of the processing unit.

In a preferred embodiment the array of receiving spaces is an orthogonal array, in which the receiving spaces are arranged in rows and columns extending perpendicularly to each other. In such an orthogonal array the receiving spaces are arranged in a rectangular pattern. The orthogonal array can be easily fabricated and generally provides a very good resolution.

It may be preferred that the receiving spaces of the array have an equal spacing in a row direction and/or in a column direction. In other words, a pitch of the receiving spaces in the row direction and/or the column direction may be preferably equal throughout the array. The equal pitch may allow for a constant marking resolution throughout the array.

The marking apparatus may for example be a printing apparatus, in particular for printing or engraving an object by means of at least one laser beam. The marking apparatus can particularly be configured for a successive marking operation, in which the object is marked by a consecutive operation of the individual marking devices, that is, the object is marked line by line or pixel by pixel, in particular while the object is moved relative to the marking head.

The marking devices may in particular be marking devices for marking, printing and/or engraving the object with at least one laser beam. However, the marking devices can also include inkjet nozzles, thermal printing devices, needle printing devices, micro pad printing devices, water jets, electrical discharge machining devices and/or any other types of marking devices. It is also possible to include different types of marking devices in the marking head.

The at least one detector device may in particular be an optical sensor device and may comprise for example a PIN diode, a photo diode, a photo sensor or a photo transistor, for sensing or scanning the object.

It may be preferred that for detecting the control marking on the object, light is transmitted to the object, the light is at least partly reflected and/or scattered by the object and the reflected and/or scattered light is detected by a sensor element. The light may be visible light, infrared light and/or any other type of electromagnetic radiation.

In a preferred embodiment a marking device and/or a detector device comprises a ferrule with at least one fibre arranged therein. In case of a marking device, the fibre may be coupled to a laser device. In case of a detector device, the fibre may be coupled to a sensor element.

In a preferred embodiment the receiving spaces of the marking and/or scanning head are receiving holes formed in a receiving plate. The receiving holes may in particular be through-holes. The marking devices may be inserted into the receiving holes and thereby coupled to the receiving plate.

Regarding the inventive methods it may be preferred that the detector device is moved in a transverse direction relative to the advance direction and the control marking is detected by the detector device during the movement of the detector device in the transverse direction.

The control marking can for example be analysed. It may be particularly preferred that a width or brightness of a control marking line is determined.

In yet another preferred embodiment a plurality of receiving spaces arranged in one column is equipped with a marking device the marking head is arranged in a tilted position in which the column of marking devices is inclined with regard to the advance direction of the object a control marking is applied by the plurality of marking devices during the movement of the object relative to the marking head, which control marking is a wide control bar due to the tilted position of the marking head, and the control bar is detected by the detector device, which is arranged downstream of the marking devices. It may be particularly preferred that the control bar is analyzed. For example, the resolution of the control bar may be determined. Based on the determined resolution the tilt angle of the marking head may be adjusted in order to achieve a desired resolution.

BRIEF DESCRIPTION OF THE DRAWINGS

The invention will now be further described with reference to the attached figures, wherein.

In all figures, identical components are identified by identical reference signs.

DETAILED DESCRIPTION OF THE INVENTION

Figure 1:
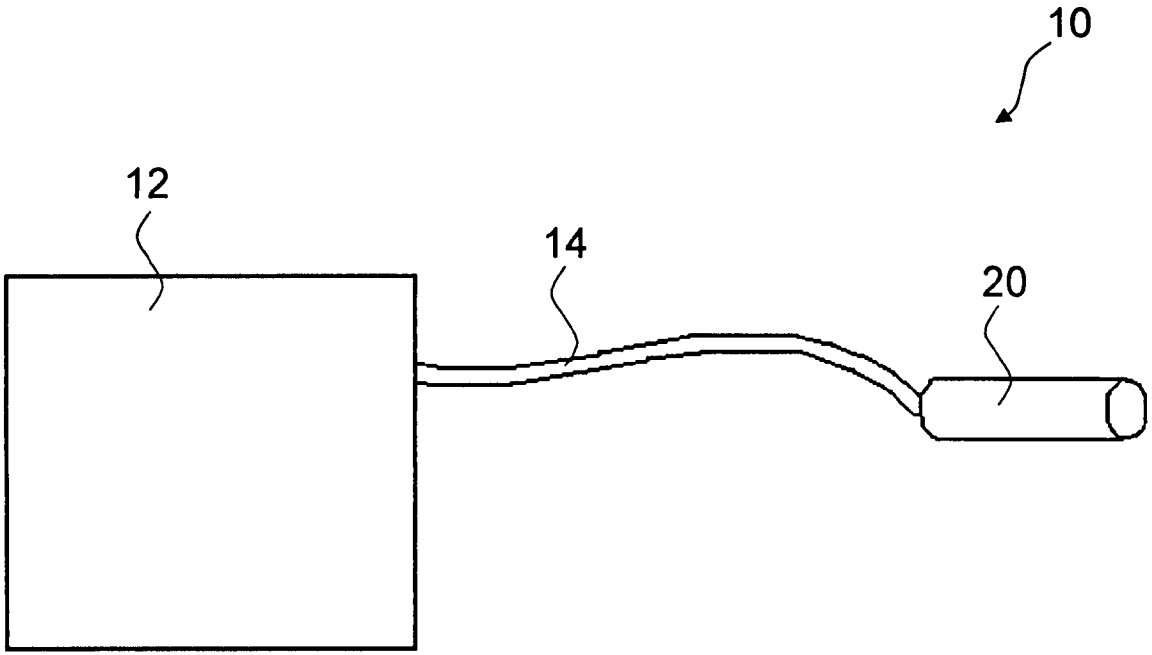
FIG. 1 shows a marking apparatus according to the invention.
Figure 2:
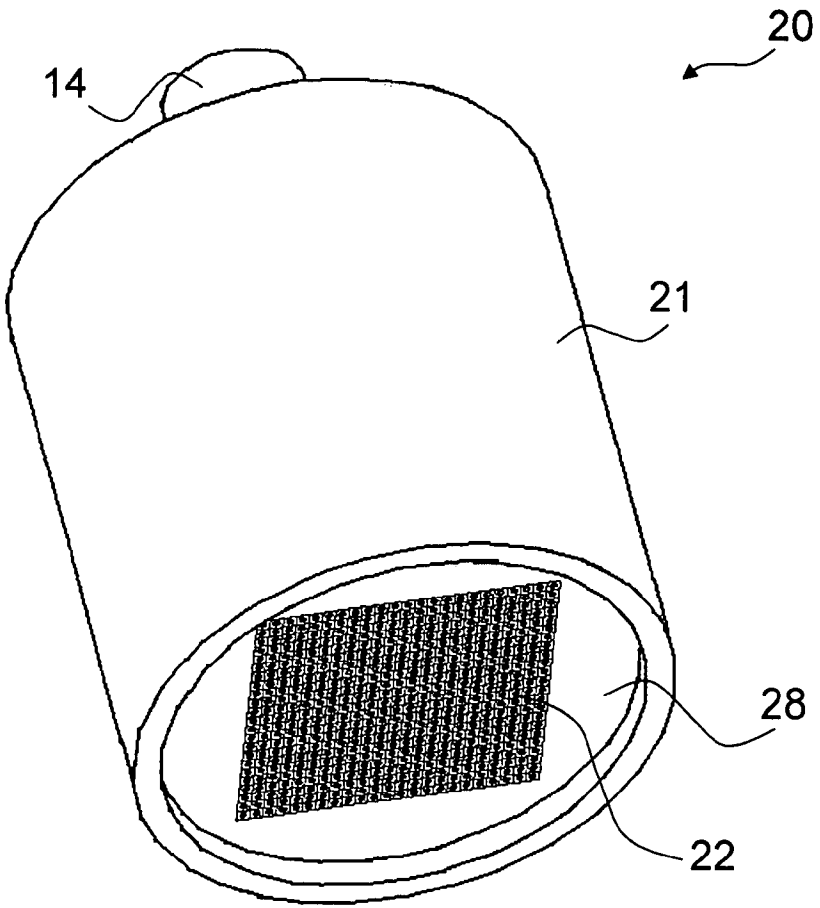
FIG. 2 shows a general perspective view of a marking head according to the invention.

The principal structure of a marking apparatus 10 according to the invention is shown in FIG. 1. The marking apparatus 10 comprises a marking head 20 with a plurality of marking devices 40. The apparatus 10 further comprises a control and driving unit 12 for controlling the marking devices 40. The control and driving unit 12 is connected to the marking head 20 through an umbilical 14. The umbilical 14 may have a plurality of fibres arranged therein. The marking head 20 may in particular be a printing head and may have a cylindrical housing 21.

Additional features of the marking head 20 are shown in FIGS. 2, 3, 5, and 7. The marking head 20 includes a plurality of receiving spaces 24 that may be equipped with individual marking devices 40. The receiving spaces 24 are arranged in a two-dimensional array 22 having a substantially rectangular outer shape.

The receiving spaces 24 are arranged in rows 30 and columns 32 extending perpendicularly to each other. The receiving spaces 24 are thus arranged in a rectangular or square pattern, which may also be called a matrix, in particular a two-dimensional matrix.

The receiving spaces 24 have equal distances or an equal spacing, so that a regular pattern is formed. The spacing between two adjacent receiving spaces 24, more particularly the distance between the central points of two adjacent receiving spaces 24 in one row, is called a row pitch. Accordingly, the spacing between two adjacent receiving spaces in one column 32 is called a column pitch. The receiving spaces 24 have equal row pitches and equal column pitches.

In the shown embodiment the marking head 20 is rotated to a degree in which the receiving spaces 24 of one column 32 are tilted or inclined with regard to a movement direction 16 of an object 80 to be marked. The movement direction is called an advance direction 16 of the object 80 relative to the marking head 20.

Figure 7:
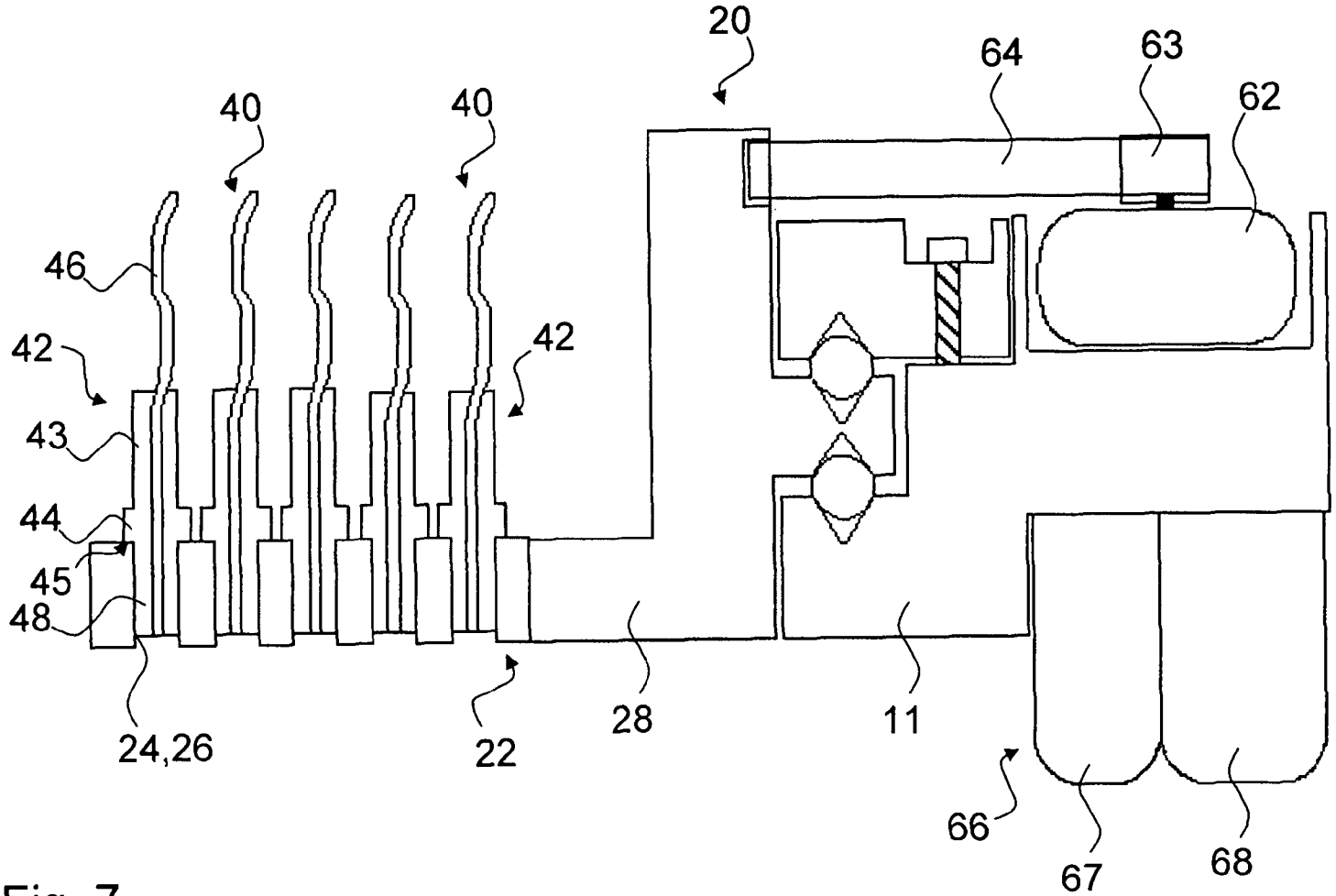

FIG. 7 shows a cross-sectional view of an inventive rotatable marking head 20. The marking head 20 includes a receiving plate 28 having a plurality of receiving holes 26 forming the receiving spaces 24. The receiving plate 28 may for example be a metal plate, in particular a steel plate. The receiving holes 26 each have a substantially circular cross-section and may in particular be through-holes. The receiving holes 26 each have equal diameters.

In addition to the array 22 of receiving spaces 24, a plurality of spare receiving spaces 25 is provided for accommodating spare marking devices 41. The spare receiving spaces 25 are also formed as receiving holes in the receiving plate 28.

The marking devices 40 each comprise a ferrule 42, in which at least one fibre end of a fibre 46 is arranged. The ferrule 42 is configured for a mating engagement with the receiving holes 26 of the marking head 20 and may in particular have a substantially cylindrical body 43 with a cylindrical connecting portion 48 for engaging the receiving hole 26. The body 43 comprises a collar 44 with an abutment surface 45 for contacting a planar surface of the receiving plate 28. In a preferred embodiment the body 43 of the ferrule 42 includes a metal, a ceramic, a plastic material or glass. It may be particularly preferred that the ferrule 42 includes steal or zirconia.

The at least one optical fibre 46 is arranged in the ferrule 42 along a longitudinal axis of the ferrule 42. The fibre 46 may be configured to transmit a laser beam onto a surface of the object 80 for a laser marking operation, in particular a laser engraving operation. To this end, the fibre 46 may be coupled to a laser so that a laser beam is transmittable through the fibre 46 onto a surface of the object 80 for marking the object 80.

The marking head 20 comprises a shielding device 66 for shielding radiation from a zone between the marking head 20 and an object 80 to be marked. The shielding device 66 comprises an inner brush ring 67 and an outer brush ring 68.

A motor 62, for example a stepper motor, is arranged for rotating the marking head 20 and/or the receiving plate 28 relative to a base 11. A transmission 64, which in the shown embodiment may be a belt, is arranged between an output shaft or a driving pulley 63 of the motor 62 and the marking head 20 for transmitting a rotational motion of the output shaft to the marking head 20 and/or the receiving plate 28.

The marking head 20 further comprises a detecting unit 70 with a detector device 50. The detector device 50 can include an optical sensor element. In a preferred embodiment the detector device includes a ferrule with an optical fibre coupled to the sensor element. The ferrule of the detector device 50 may be configured as described in connection with the marking device 40.

The detector device 50 is mounted on a slider 72 which is movable with regard to the array of receiving spaces 24 of the marking head 20. The receiving plate 28 can have a cut out in which the slider 72 or carriage can be moved. A drive unit 74 is provided for moving the slider 72. The drive unit 74 comprises a spindle drive with a threaded rod or spindle 78. The spindle 78 is connected to a motor 76, for example a stepper motor, for rotating the spindle 78.

As shown, the detecting unit 70 can also have a second or spare detector device 51 arranged on the slider 72.

Embodiments of the inventive method will now be described with reference to FIGS. 3 to 6. The inventive method can be called a calibration method.

Figure 3:
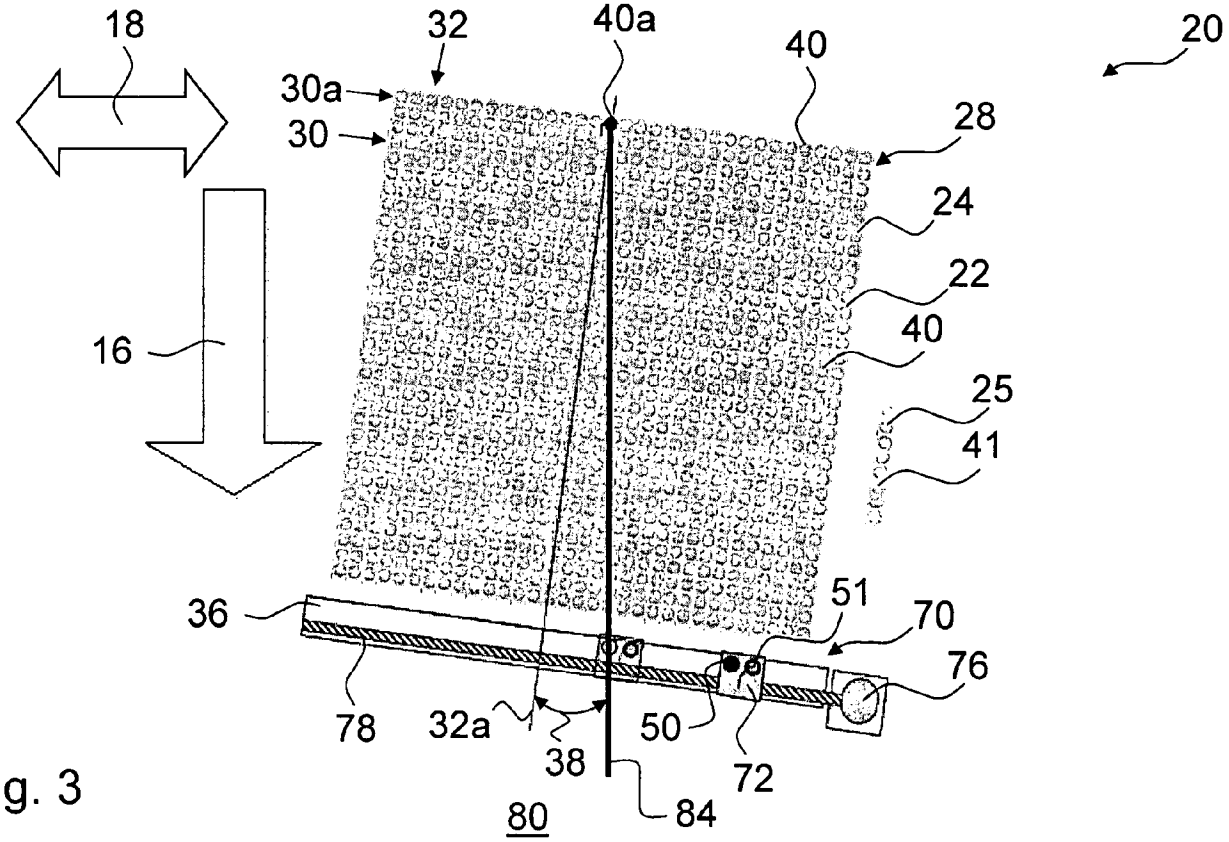
FIG. 3 shows a marking head according to the invention and a first method for operating the marking head.
Figure 4:
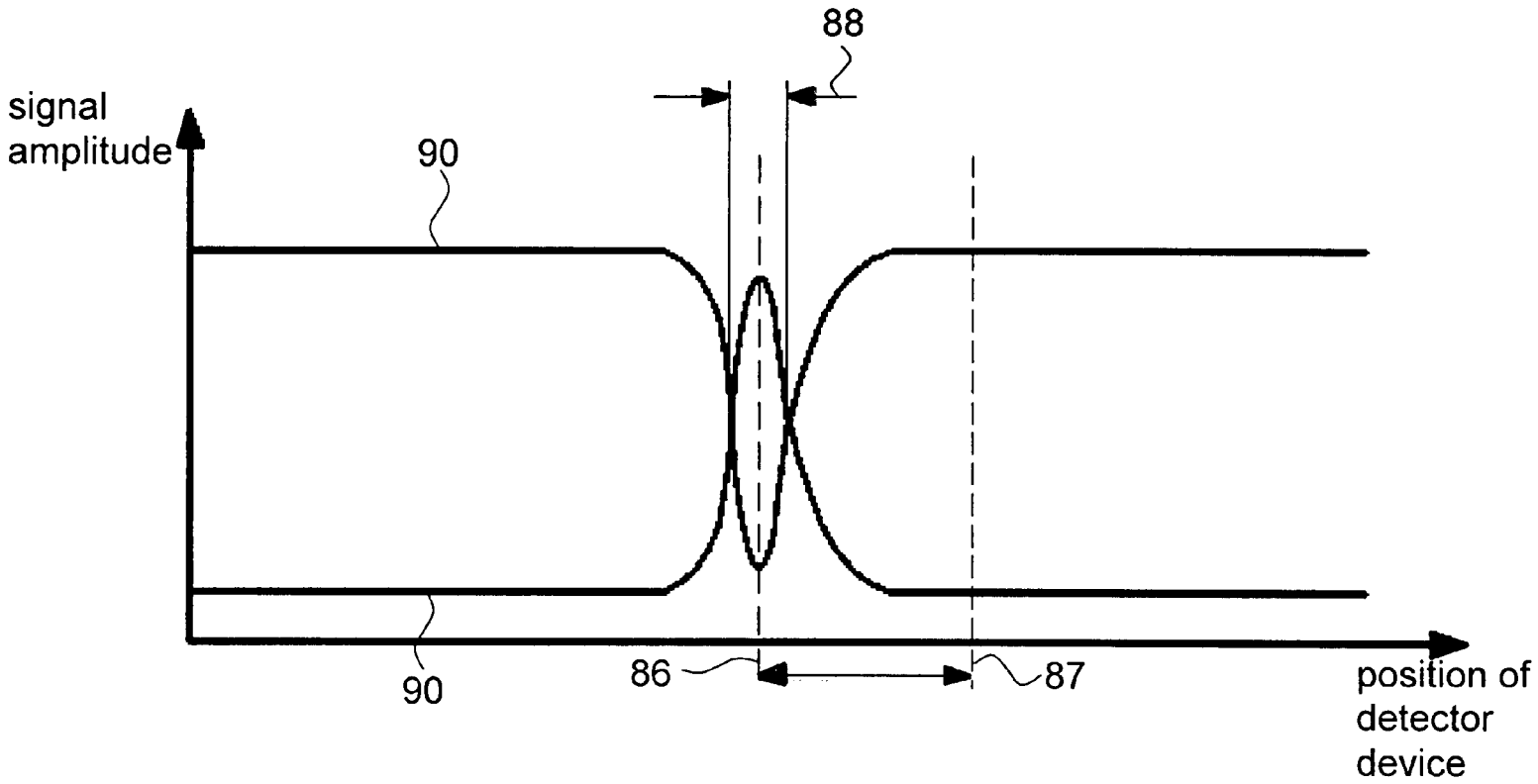
FIG. 4 shows detecting signals detected by the detector device in the first method.

A first embodiment of the inventive method is illustrated in FIGS. 3 and 4. The first method can be used for determining a rotation or tilt angle 38 of the marking head 20 relative to the advance direction 16 of the object 80 to be marked or printed. It may be useful to carry out this method after an installation of the marking head 20 or after an object change.

According to the method a single marking device 40 of the marking head 20 is activated and applies a marking called a reference or control marking 84 onto the object 80. The activated marking device 40, which may also be called a control marking device 40*a*, may preferably be a marking device 40 arranged in a top row 30*a* of the marking head 20, that is, a first row 30a in the advance direction 16. The column position of the activated marking device 40 is identified by the line 32*a*. Other marking devices 40 of the marking head 20 may be deactivated during the carrying out of the method.

The object 80 is moved in the advance direction 16 while the control marking device 40*a* applies the control marking 84 on the object 80. The control marking 80 can in particular be a control marking line.

The detector device 50 is moved along a defined movement path 36 in a transverse direction 18, parallel to the rows 30 of the receiving spaces 24. When the detector device 50 passes the control marking 84, this marking is detected. Due to the known position of the detector device 50 relative to the control marking device 40*a*, the tilt angle 38 of the marking head 20 can be calculated.

FIG. 4 shows a detector signal 90 of the detector device 50, in particular a signal amplitude over a slider or detector device position, when the detector device 50 detects the control marking line 84. The upper line shows a signal 90 of the detector device 50 when a dark line is detected on a bright background. The lower line shows a signal 90 of the detector device 50 when a bright line is detected on a dark background. The minimum and maximum, respectively, of the signal 90 determines the marking line centre 86.

The position of the control marking line is identified by the dotted line 86. The column position of the activated marking device 40*a* is shown by the dotted line 87. A distance between the lines 86 and 87 corresponds to an actual rotation or tilt angle 38 of the marking head 20. In addition the marking line width 88 can be determined based on the signal shape.

In a corresponding manner a power of a marking device 40 can be calibrated with the inventive marking apparatus 10. The optimal power of a marking device 40 can in particular depend on the substrate, i.e. the object 80, to be marked. When the control line starts to appear in the signal the minimum power requirement is set for the current substrate. When the detected line does not get wider or darker, the maximum power requirement is set for the current substrate.

Figure 5:
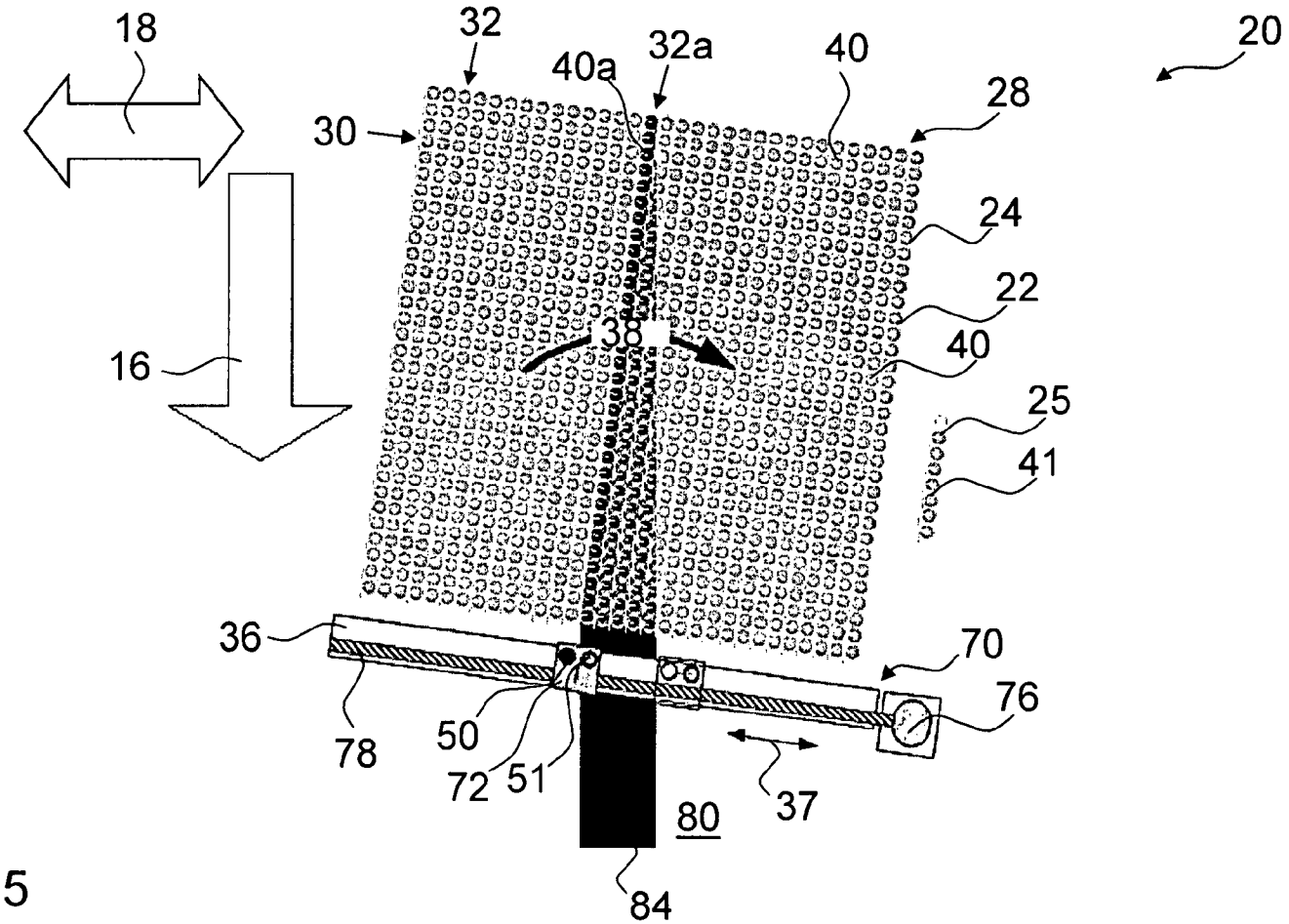
FIG. 5 shows the marking head according to FIG. 3 and a second method for operating the marking head.
Figure 6:
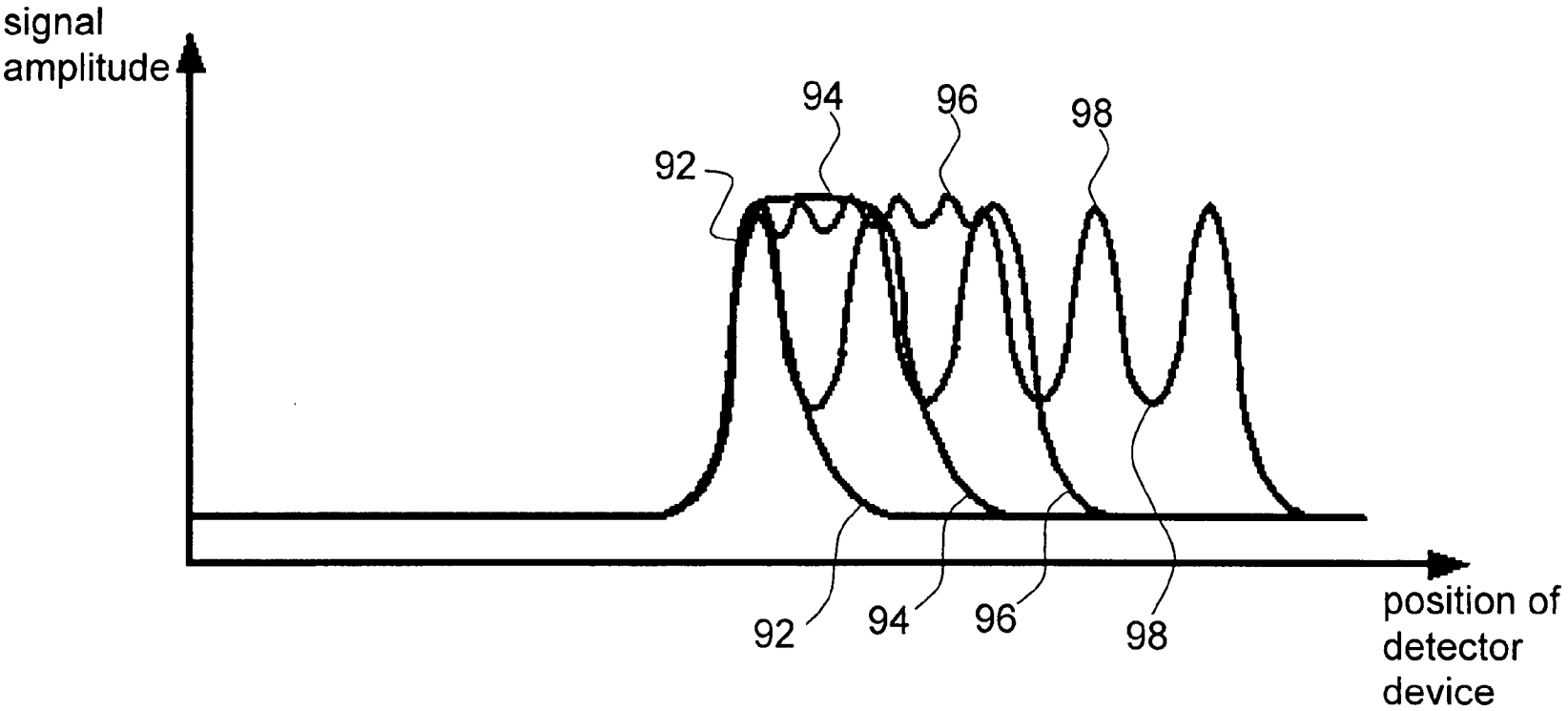
FIG. 6 shows detecting signals detected by the detector device in the second method and FIG. 7 shows a cross-sectional view of an inventive marking head.

A second embodiment of the inventive method is illustrated in FIGS. 5 and 6. The second method can be used for determining an optimal tilt angle 38 of the marking head 20 relative to the advance direction 16, wherein the optimal tilt angle 38 can be a maximum tilt angle 38 in which a solid line may be marked in a perpendicular direction relative to the advance direction 16.

A plurality of marking devices 40*a* of one column 32*a* of the marking head 20 is activated and a control marking 84 is applied on the object 80 during a movement of the object 80 in the advance direction 16. The detector device 50 is moved along a defined movement path 36 in a transverse direction 18, parallel to the rows 30 of the receiving spaces 24. When the detector device 50 passes the control marking 84, this marking is detected.

After the detection of the control marking 84 the tilt angle 38 of the marking head 20 is changed, in particular increased. The detector device 50 is then again moved and the control marking 84 is again detected. Due to the increased tilt angle 38, the width 88 of the control marking 84 increases.

The above described steps can be repeated. That is, after each slider pass, or detector device pass, the tilt angle 38 of the marking head 20 is slightly increased. Therefore the slider 72 and/or the detector device 50 performs an oscillating movement, as shown by the arrow 37.

Different detector signals referring to different tilt angles 38 are shown in FIG. 6. As in FIG. 4, the figure shows a signal amplitude over a slider or detector position.

A first detector signal 92 refers to a relatively small first tilt angle. With an increasing tilt angle the line signal width increases. For example, a second detector signal 94 refers to a tilt angle which is greater than the first tilt angle. If the signal starts to form local minima or maxima the marking lines start to separate, as can be seen in the detector signals 96 and 98. The local minima or maxima are an indication of a resolution which does not provide the possibility to mark or print continuous lines in a direction perpendicular to the advance direction with a high quality.

Therefore, the invention provides a method for analysing the quality of a marking to be achieved with different tilting angles. A tilting angle referring to a signal right before the minima or maxima appear can be considered an optimal tilting angle.

The invention claimed is:

1. A marking apparatus for marking an object, comprising:

a marking head having a plurality of receiving spaces for individual marking devices, wherein the receiving spaces are arranged in a plurality of rows and columns, such that a two-dimensional array of receiving spaces is formed, and a driving mechanism for providing a relative movement of the object relative to the marking head in an advance direction during a marking operation, wherein the marking head is rotatable about an axis extending transversely to the advance direction, wherein at least one detector device is arranged within the rotatable marking head downstream of the receiving spaces in the advance direction, wherein by the arrangement of the at least one detector device within the rotatable marking head, a distance between the at least one detector device and the individual marking devices is unaffected by a rotation of the marking head, and a control marking, which has been applied by at least one marking device arranged in one of the receiving spaces during the movement of the object relative to the marking head, is detectable by the at least one detector device at different angles of rotation of the marking head, a processing unit is provided for determining a value of an angle of rotation based on the detected control marking.

2. The marking apparatus of claim 1, wherein the at least one detector device is movable along a defined movement path relative to the receiving spaces of the marking head.

3. The marking apparatus of claim 1, wherein the at least one detector device is movable in a transverse direction with regard to the advance direction.

4. The marking apparatus of claim 1, wherein the at least one detector device is movable along a defined movement path such that it may be placed in a position in which it is aligned in the advance direction with at least one of the receiving spaces, at different angles of rotation of the marking head.

5. The marking apparatus of claim 1, wherein the at least one detector device is movable along a linear movement path.

6. The marking apparatus of claim 1, wherein a measuring device is provided for determining the position of the detector device detecting the control marking.

7. The marking apparatus of claim 1, wherein a processing unit is provided for determining a characteristic of the detected control marking.

8. The marking apparatus of claim 1, wherein a motor is provided for rotating the marking head.

9. A method for operating a marking apparatus, wherein the marking apparatus comprises a marking head which is rotatable about an axis extending transversely to an advance direction the marking head comprises a plurality of receiving spaces for individual marking devices for marking an object, the receiving spaces being arranged in a plurality of rows and columns, such that a two-dimensional array of receiving spaces is formed, and at least one receiving space is equipped with a marking device, wherein the method comprises the steps:

the object is moved relative to the marking head in the advance direction, and a control marking is applied by the at least one marking device during the movement of the object relative to the marking head, the control marking is detected by a detector device, which is arranged within the rotatable marking head downstream of the at least one marking device, wherein by the arrangement of the detector device within the rotatable marking head, a distance between the detector device and the at least one marking device is unaffected by a rotation of the marking head, wherein a processing unit is provided for determining a value of an angle of rotation based on the detected control marking.

10. The method of claim 9, wherein the detector device is moved in a transverse direction relative to the advance direction, at a specific position of the detector device during the movement in the transverse direction, the detector device detects the control marking, said specific position is determined, a geometric relationship of the specific position of the detector device relative to a position of the marking device that has produced the control marking is determined, and the geometric relationship is used to determine the angle of rotation of the marking head.

11. The method of claim 9, wherein an angle of rotation of the marking head is determined based on the control marking.

12. The method of claim 9, wherein a plurality of receiving spaces arranged in one column is each equipped with a marking device, the marking head is arranged in a tilted position in which the column of marking devices is inclined with regard to the advance direction of the object, the control marking is applied by the plurality of marking devices during the movement of the object relative to the marking head, which control marking is a wide control bar due to the tilted position of the marking head, and the control bar is detected by the detector device, which is arranged downstream of the marking devices.

13. A marking apparatus for marking an object, comprising:

a marking head having a plurality of receiving spaces for individual marking devices, wherein the receiving spaces are arranged in a plurality of rows and columns, such that a two-dimensional array of receiving spaces is formed, and a driving mechanism for providing a relative movement of the object relative to the marking head in an advance direction during a marking operation, wherein the marking head is rotatable about an axis extending transversely to the advance direction, wherein at least one detector device is arranged within the rotatable marking head downstream of the receiving spaces in the advance direction, and a control marking, which has been applied by at least one marking device arranged in one of the receiving spaces during the movement of the object relative to the marking head, is detectable by the at least one detector device at different angles of rotation of the marking head, a processing unit is provided for determining a value of an angle of rotation based on the detected control marking.

* * * * *